US008695237B2

(12) United States Patent
Melville

(10) Patent No.: US 8,695,237 B2
(45) Date of Patent: Apr. 15, 2014

(54) APPARATUS FOR FORMING A TERRAIN FEATURE

(76) Inventor: John Featherstone Melville, Wanaka (NZ)

( * ) Notice: Subject to any disclaimer, the term of this patent is extended or adjusted under 35 U.S.C. 154(b) by 391 days.

(21) Appl. No.: 13/055,934

(22) PCT Filed: Jul. 24, 2009

(86) PCT No.: PCT/NZ2009/000148

§ 371 (c)(1),
(2), (4) Date: Jan. 25, 2011

(87) PCT Pub. No.: WO2010/011149

PCT Pub. Date: Jan. 28, 2010

(65) Prior Publication Data

US 2011/0126433 A1 Jun. 2, 2011

(30) Foreign Application Priority Data

Jul. 25, 2008 (NZ) ..... 570113

(51) Int. Cl.
*E01H 4/00* (2006.01)

(52) U.S. Cl.
USPC ..... 37/221

(58) Field of Classification Search
USPC ..... 37/196, 197, 200, 219, 237, 240–244, 37/464, 465, 220–224
See application file for complete search history.

(56) References Cited

U.S. PATENT DOCUMENTS

| | | | | |
|---|---|---|---|---|
| 4,571,117 A | | 2/1986 | Johnson et al. | |
| 5,940,995 A | * | 8/1999 | Venhomaa | 37/240 |
| 6,085,445 A | | 7/2000 | Kanzler | |
| 6,247,538 B1 | | 6/2001 | Takeda et al. | |
| 6,516,543 B1 | * | 2/2003 | Bishop et al. | 37/219 |
| 6,948,266 B1 | * | 9/2005 | Steedman et al. | 37/221 |

FOREIGN PATENT DOCUMENTS

| | | | |
|---|---|---|---|
| DE | 19648872 | A1 | 5/1998 |
| DE | 19730233 | A1 | 1/1999 |
| EP | 1036885 | A1 | 9/2000 |
| EP | 0950874 | B1 | 5/2004 |
| WO | WO 97/29243 | A1 | 8/1997 |
| WO | WO 99/18292 | A1 | 4/1999 |

(Continued)

OTHER PUBLICATIONS

International Search Report for PCT/NZ2009/000148 issued Oct. 27, 2009.

(Continued)

*Primary Examiner* — Robert Pezzuto
(74) *Attorney, Agent, or Firm* — Henry B. Ward, III

(57) ABSTRACT

The present invention relates to an apparatus for forming a terrain feature such as a snow half pipe used by snowboarders or skiers. Known half-pipe cutters are inaccurate and limited in height which limits the quality of the formed snow course. The apparatus comprises a frame which comprises an attachment for a self-actuated vehicle and a tool member adapted to the cross-sectional shape of the terrain feature; at least one primary forming surface, such as a belt, running over a working surface of the tool member to form the terrain feature; at least one secondary forming surface, in the form of a heated bar and finishing mats, to contact the formed terrain feature and provide a finish to its surface; and a guidance device, such as a laser guided device, to determine the position of the tool member with respect to the terrain surface.

27 Claims, 4 Drawing Sheets

(56) References Cited

FOREIGN PATENT DOCUMENTS

| | | | |
|---|---|---|---|
| WO | WO 01/18314 | A1 | 3/2001 |
| WO | WO 2004/027160 | | 4/2004 |
| WO | WO 2005/064085 | A1 | 7/2005 |

OTHER PUBLICATIONS

International Preliminary Report on Patentability for PCT/NZ2009/000148 issued Nov. 9, 2010.

* cited by examiner

APPARATUS FOR FORMING A TERRAIN FEATURE

FIELD OF THE INVENTION

The present invention relates to an apparatus for forming a terrain feature. Particularly, although not exclusively, the present invention relates to an apparatus for cutting and/or shaping various snow terrain features such as the walls of a snow half pipe of the type used by snowboarders and/or freestyle skiers.

STATEMENT OF CORRESPONDING APPLICATIONS

The present invention is based on the provisional specification filed in relation to New Zealand Patent Application No. 570113, the entire contents of which are incorporated herein.

BACKGROUND OF THE INVENTION

Snowboarding is now well established worldwide as a recreational and competitive sport. In addition to being able to undertake a variety of aerial jumps and spins snowboarders and skiers have the opportunity to perform these in specially constructed terrain features such as snow half pipes. A half-pipe is a channel substantially U-shaped in cross-section consisting of two concave ramps (or quarter pipes), topped by decks, facing each other across the channel. In many instances the basic shape of half pipes are created in summer out of rock and soil and in winter covered in snow either naturally or artificially.

A half pipe can be made of various lengths but in the main does not exceed 150 meters in length. The half pipe's plane of transition is orientated downhill at a slight inclination. This enables riders to use gravity to assist them to perform their various maneuvers. The character of a half pipe depends on the relationship between four important qualities being the transition radius and the height together with the amount of flat bottom and the width of the half pipe. It is the ratio between height and transition radius that determines the personality and characteristics of any given pipe because this ratio determines the angle of the lip from which the user commences a run.

Currently terrain features such as snow half pipes are created by an arm attachment to a half pipe cutter machine somewhat similar in appearance to a grain elevator. These half pipe cutters suffer from a number of drawbacks including high overall weight and uneven weight distribution which makes them cumbersome to operate and can limit the quality of the snow course and subsequent enjoyment of the user. Further, most known half-pipe cutters are unable to cut above 18 feet without a bolt-on addition to the boom. In addition manual operation of known half pipe cutters can result in inaccurate half pipe formation with an uneven surface due to human error.

It is an object of the present invention to address the foregoing problems or at least to provide the public with a useful choice.

Further aspects and advantages of the present invention will become apparent from the ensuing description which is given by way of example only.

It is acknowledged that the term 'comprising' may, under varying jurisdictions, be attributed with either an exclusive or an inclusive meaning. For the purpose of this specification, and unless otherwise noted, the term 'comprising' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

SUMMARY OF THE INVENTION

According to one aspect of the present invention there is provided an apparatus for forming a terrain feature, the apparatus comprising:

at least one primary forming surface to form a terrain feature, the primary forming surface configured to run over a working surface of a tool member, the working surface adapted to the cross-sectional shape of a preferred contour of the terrain feature wherein the apparatus also comprises at least one secondary forming surface configured to contact the terrain feature and provide a finish to the surface of the terrain feature formed with the primary surface.

For the purposes of the specification, the term "terrain feature" may be a half pipe, jump, spine, table top or the like formed in a loosely compacted material such as snow; ice; earth; soil or sand.

Preferably, the primary forming surface may comprise at least one looped belt, the looped belt comprising a base structure for attachment to the tool member and at least one cutting edge for cutting a terrain surface.

Preferably, the primary forming surface is made of a flexible material.

More preferably, the flexible material is polyethylene.

Preferably, the working surface of the tool member is arcuate.

More preferably, the working surface of the tool member is a quarter ellipse.

Preferably, the length of the tool member may be in the range 5 to 30 feet.

Preferably, the secondary surface may extend substantially perpendicular to the plane of the length of the tool member.

Preferably, the secondary surface comprises a rigid plate.

More preferably, the rigid plate is made of rolled hollow steel.

More preferably, the rigid plate is heated to provide a finish to the formed surface of the terrain feature.

Preferably, the secondary surface comprises at least one flexible mat.

Preferably, the secondary surface is textured.

Preferably, the apparatus for forming a terrain feature also comprises a frame for attachment to a self-actuated vehicle.

Preferably, the apparatus for forming a terrain feature also comprises a guidance device configured to determine the position of the tool member with respect to a terrain surface.

More preferably, the guidance device comprises a sensor to detect the location of at least one reference signal positioned on a terrain surface (and optionally) to detect the angle of slope of the terrain feature.

More preferably still, the guidance device comprises a processor to calculate the position of the tool member with respect to the detected reference signal(s) and convert resulting processed positional information to an output signal for display on a visual display.

More preferably still, the positional information may comprise the height of the tool member with respect to the terrain surface and the inclination of the tool member with respect to the terrain surface.

More preferably still, the guidance device also comprises a controller to receive the positional information and control the movement of the tool member with respect to the terrain surface.

More preferably still, the reference signal is a laser reference signal.

More preferably still, the reference signal is a sonic reference signal.

More preferably still, the reference signal is a GPS reference signal.

According to another aspect of the present invention there is provided a method of forming a terrain feature using the apparatus the subject of this specification, the method comprising the steps of:

a. forming a terrain feature with at least one primary surface wherein the method also comprises the step of:

b. providing a finish to the formed surface of the terrain feature with at least one secondary surface.

Preferably, the method also comprises the step of:

c. using a guidance device to determine the position of the tool member with respect to a terrain surface.

Thus, preferred embodiments of the present invention may have a number of advantages over the prior art which can include:

Providing an improved finish (such as a textured or smoothed surface) to a formed surface of a terrain feature;

Providing a greater range of sizes for a terrain feature (including snow half-pipe heights of up to 30 feet);

Improved ease of use in forming a terrain feature; and

Improved accuracy of forming a terrain feature.

BRIEF DESCRIPTION OF DRAWINGS

The present invention will now be described by way of example only and with reference to the accompanying drawings in which.

DETAILED DESCRIPTION OF THE INVENTION

Figure 1:
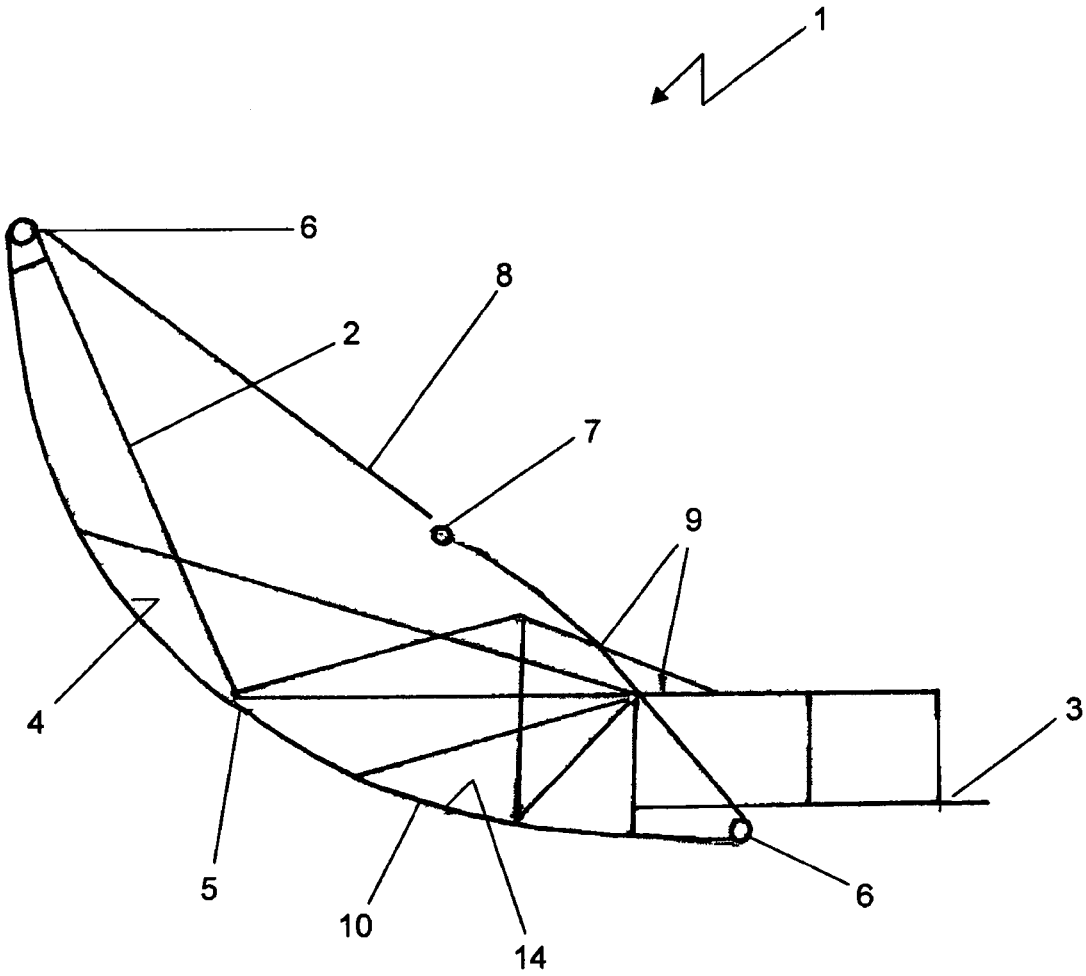
FIG. 1 shows a side view of a preferred embodiment of the present invention in the form of an apparatus for forming a terrain feature.
Figure 2:
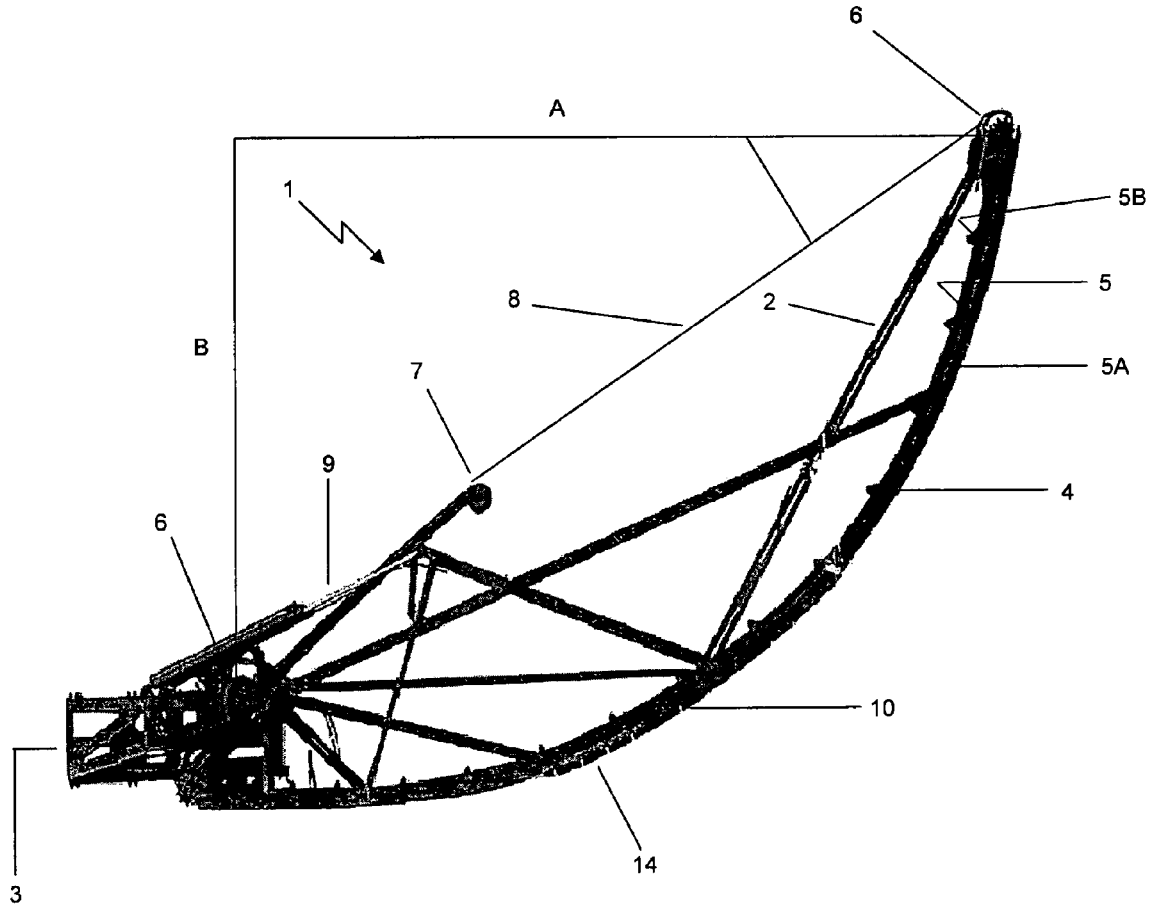
FIG. 2 shows a photographic illustration of a side view of the preferred embodiment of the present invention shown in FIG. 1.

FIGS. 1 and 2 show a side elevation of an apparatus for forming a terrain feature generally indicated by arrow 1 in its "in use" position. For ease of reference the present invention will now be described in relation to forming a terrain feature form that is a snow half-pipe. However it should be appreciated that the present invention has utility to forming other terrain features in snow, ice, sand, soil or the like.

The apparatus 1 can be retrofitted to an existing self-actuated vehicle such as a Snow Cat (not shown). A frame 2 in the form of a steel space frame is adapted for attachment to the front or back of said vehicle via hitching face 3.

An integral tool member 4 in the form of a boom forms a substantially quarter ellipse corresponding to half the cross-sectional shape of a half-pipe (known as a quarter pipe) as used by recreational snowboarders and skiers.

At least one primary forming surface in the form of a polyethylene belt 5 is configured to run in an endless loop over a working length of the tool member 4. The belt 5 comprises a base structure 5A (shown in FIG. 2) for attachment to the tool member 4 and at least one cutting edge 5B (shown in FIG. 2) for cutting a terrain surface. Lateral movement of the tool member 4 along a snow embankment 15A (in FIG. 4) causes the belt 5 to form the snow quarter pipe by cutting into the snow with the cutting edges 5B.

It will be appreciated by those skilled in the art that the primary forming surface may be any material which is flexible enough to be driven in an endless loop over the tool member 4 and resilient enough to contact a terrain surface. For example an alternative to an endless belt might be a looped chain or similar.

Each belt 5 forms a continuous loop around the length of the tool member 4 and is supported by gears 6 at each extremity of the quarter elipse of frame 2. The arcuate surface of the tool member 4 between each gear 6 defines a working length of the tool member 4. Each gear 6 is driven by a hydraulic drive motor (not shown), at the distal ends of the tool member 4 on the same horizontal axis to reduce belt 5 tension. The motors can be driven bidirectionally, in a clockwise direction to drive the belt 5 in a clockwise cutting motion and in an anticlockwise direction to drive the belt 5 in an anticlockwise paddling motion up an inclined surface.

A guide wheel 7 supports the belt 5 on its return travel 8 back to the working length of the tool member 4. The belt 5 is then unsupported for the remainder of its length producing a weight saving.

The amount of steel used in the construction of the frame 2 is a substantial factor in the minimal overall weight of the apparatus 1. The steel construction is greater around areas of the frame 2 which are under load as the frame is pushed against a snow embankment 15A and less at the extremities of the frame 2 where the forces on the frame 2 are less. The location of the steel construction determines the weight distribution of the frame 2 and this has a substantial effect on the performance of the apparatus 1 when attached to a Snow Cat. The construction of the frame 2 allows the length of the semi-major axis (indicated by arrow A on FIG. 2) of between 5 and 23 feet and a semi-minor axis (indicated by arrow B on FIG. 2) of between 5 and 23 feet.

Actuators in the form of a pair of hydraulic rams 9 allow the vertical height of the tool member 4 to be altered when the rams 9 are actuated to the same distance. By altering the distance of actuation between the rams 9, the tool member 4 can be side shifted laterally during operation of the apparatus 1 to form a snow half-pipe.

In addition, rams 9 can be used to maneuver the frame 2 into a position for maintenance of the apparatus 1.

Figure 3:
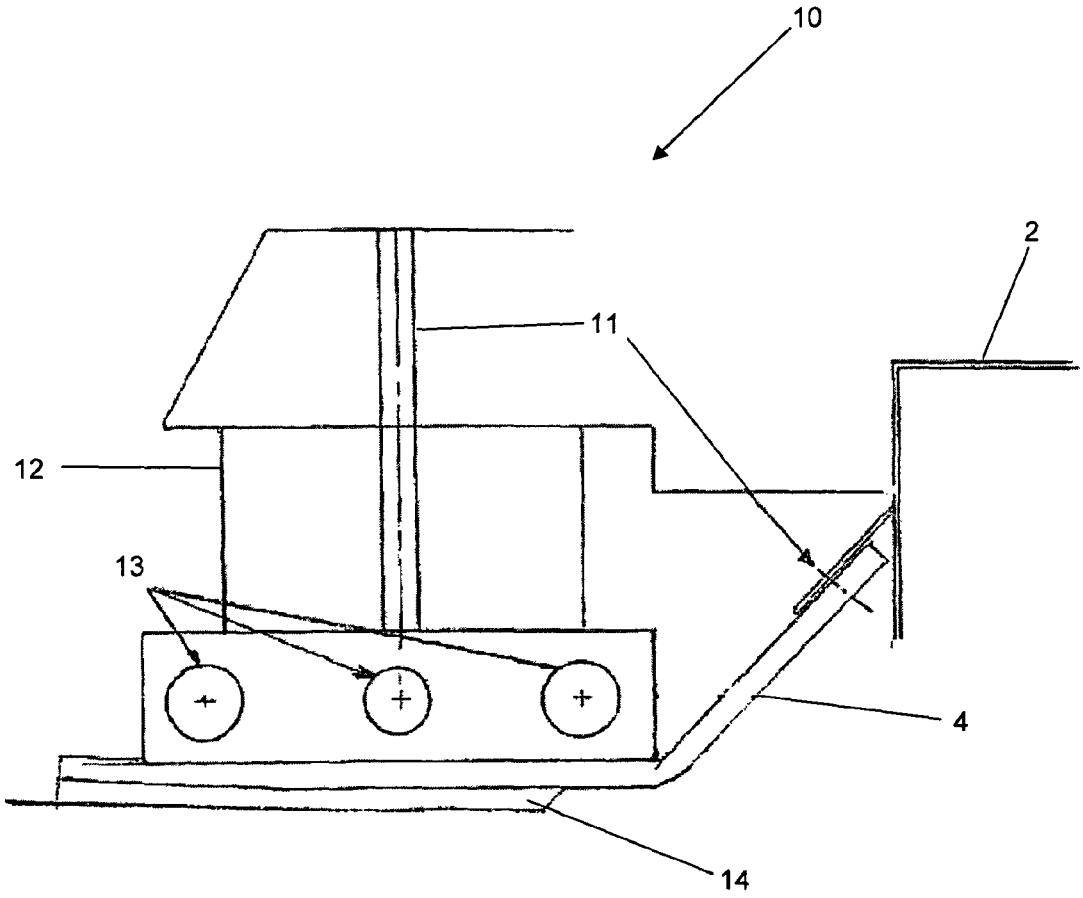
FIG. 3 shows a close up side view of the secondary forming surface of the preferred embodiment shown in FIGS. 1 and 2 in the form of a bar.

A secondary forming surface in the form of a bar 10 and finishing mat 14 allows the tool member 4 to rest its weight on a snow wall as it forms the half-pipe and provides a finish to the snow wall formed with the primary forming surface 5. FIG. 3 shows a close up side view of the bar 10. Bar 10 is attached to the frame 2 at contact points 11 and is mounted on a resilient (preferably rubber) mount 12 and extends substantially perpendicular to the plane of the working length of the tool member 4. The bar 10 also allows the frame 2 to rest on the snow wall without cutting. The bar 10 is made of rolled hollow steel.

Heat is provided through the bar 10 via hydraulic hoses 13. The finish to the formed snow half-pipe can be in the form of a glazed smooth finish or a textured finish via finishing mats 14 mounted to the underside of the bar 10.

The finishing mats 14 are made of a flexible but resilient material such as rubber. However other suitable materials can be used without departing from the scope of the present invention such as plastic or metal sheet.

Figure 4:
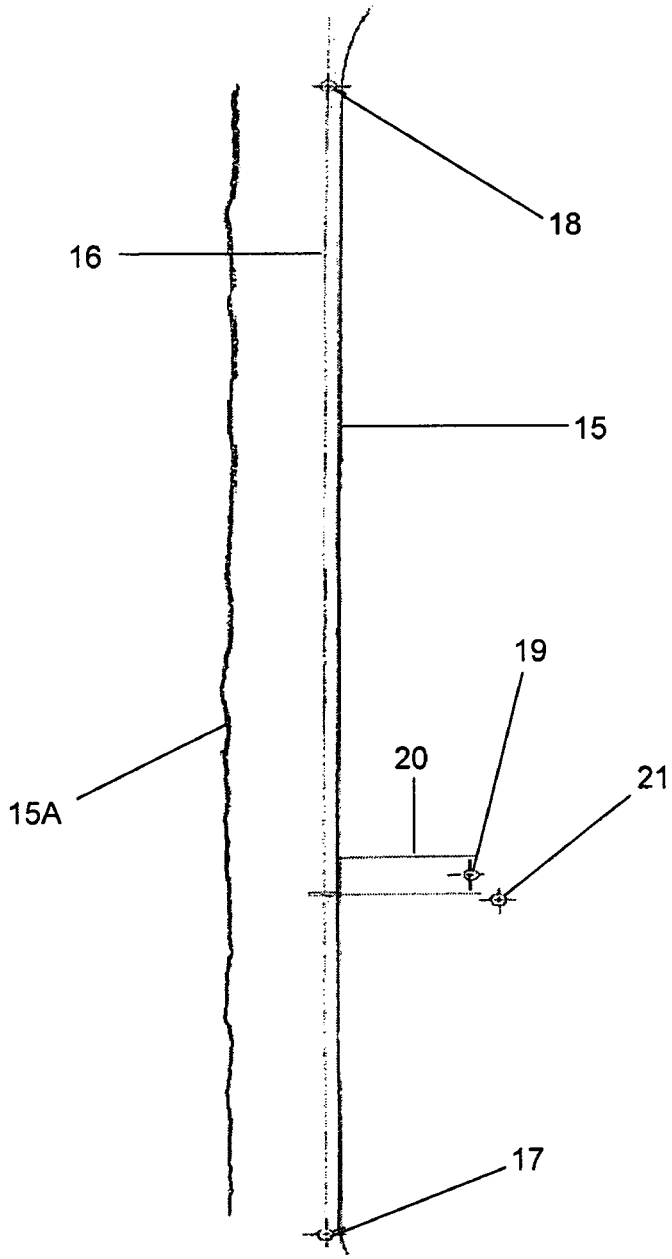
FIG. 4 shows a schematic view of a snow embankment to illustrate the method of operation of the guidance device of the apparatus shown in FIG. 1.

A guidance device (not shown) is used for guiding and controlling the frame 2 and/or the attached Snow Cat vehicle is used to determine the position of the apparatus 1 with respect to a terrain surface in the form of a snow embankment 15A (shown in FIG. 4). The guidance device senses (via a sensor) at least one laser reference signal in the form of guide lines projected from beacons positioned on the snow embankment 15A. A processor is used to receive the sensed information from the sensor and calculate processed positional information in the form of the position of the tool member 4 with respect to the snow surface and convert the processed positional information to an output signal for display on a visual display unit and/or directly to a controller to control the movement of the tool member 4 with respect to the direction of the vehicle. A person skilled in the art will appreciate that there are a number of different ways in which such a guidance device may be achieved including interpreting sonic reference signals or via a Global Positioning System (GPS) to obtain positional information of the frame with respect to the snow embankment 15A (or even a combination of such means). The processing device also comprises an inclinometer to calculate the angle of slope of the snow embankment 15A.

The positional information is processed by the processing device and used to calculate the position of the tool member 4 with respect to the detected reference signal(s) and convert the positional information to an output signal for display on a visual display unit to give the operator of the Snow Cat vehicle and apparatus 1 guidance and information on the current position of the tool member 4 on the wall including height and width. The guidance device improves the accuracy of forming a snow half-pipe and minimises the potential for human error. It also provides the ability to cut snow half-pipes reproducibly at an equal depth even with different operators. Optionally, the guidance device interfaces with Snow Cat vehicles that have digital format and thereby give automatic operating guidance.

In use the apparatus 1 can be used to form a terrain feature such as a snow half-pipe with the primary forming surface 5 and then provides a finish to the formed surface of the snow half-pipe with the secondary forming surfaces (in the form of bar 10 and finishing mats 14).

FIG. 4 shows a schematic front view of an embankment to illustrate the set up and operation of the guidance device of the apparatus 1. The guidance device is used for guiding and/or controlling of the tool member 4 of the frame 2 and/or the Snow Cat vehicle to which the apparatus 1 is attached either by manual operation or via an automatic digital interface of the Snow Cat vehicle with the guidance device or a combination of manual and automatic functions.

An embankment of snow 15 is created by placement of snow or artificial snow on a wall 15A made from earth or other material. A laser beam 16 is projected from a rotary laser unit (not shown) mounted on a post or tripod at Point 1 (17) at one end of the half pipe to be cut which is received at a rotary receiving laser unit with light box mounted on a post/tripod at Point 2 (18) at the other end of the half pipe. This laser beam is positioned so that it is clear of any obstructions such that the beam is uninterrupted. The laser beam provides a straight line with accuracy within 150 mm over the length of the half pipe to be cut.

A laser sensor unit 19 located on the tool member 4 of the apparatus 1 detects the location of a laser beam 16 between Points 1 (17) and 2 (18). A processing device then uses the positional information to calculate the position of the tool member 4 with respect to the snow wall and convert the positional information for display on a display unit to provide operating guidance for the operator of the apparatus and Snow Cat vehicle inside the vehicle.

The sensor of the guidance device 19 may include a laser inclinometer sensor to calculate the vertical angle of the half pipe and to provide operating guidance via the processor and visual display. The controller, on receiving the processed positional information from the processor, may then automatically guide the tool member 4 of the apparatus 1 with respect to the snow embankment 15A to form the snow half-pipe.

Line 21 is a typical direction of movement of the apparatus 1 and Snow Cat vehicle as it moves through the snow forming the half pipe.

Aspects of the present invention have been described by way of example only and it should be appreciated that modifications and additions may be made thereto without departing from the scope thereof as defined in the appended claims.

What we claim is:

1. An apparatus for forming a terrain feature, the apparatus comprising:

a tool member defining a working surface adapted to a cross-sectional shape of a preferred contour of the terrain feature;

at least one primary forming surface to form the terrain feature, the at least one primary forming surface comprising at least one cutting edge; and at least one secondary forming surface configured to contact the terrain feature formed with the primary forming surface, wherein:

the at least one primary forming surface is guided over a substantial portion of the working surface of the tool member via the at least one cutting edge; and the least one secondary forming surface is heated to provide a finish to the formed terrain feature.

2. An apparatus for forming a terrain feature as claimed in claim 1 wherein the primary forming surface comprises at least one looped belt, the looped belt comprising a base structure for attachment to the tool member and the at least one cutting edge for cutting a terrain surface.

3. An apparatus for forming a terrain feature as claimed in claim 2 wherein the looped belt is configured to run over the working surface of the tool member bidirectionally.

4. An apparatus for forming a terrain feature as claimed in claim 1 wherein the at least one cutting edge is also configured to transfer cut material from the terrain surface over the formed terrain feature.

5. An apparatus for forming a terrain feature as claimed in claim 1 wherein the primary forming surface is made of a flexible material.

6. An apparatus for forming a terrain feature as claimed in claim 5 wherein the flexible material is polyethylene.

7. An apparatus for forming a terrain feature as claimed in claim 1 wherein the working surface of the tool member is arcuate.

8. An apparatus for forming a terrain feature as claimed in claim 7 wherein the working surface of the tool member is a quarter ellipse.

9. An apparatus for forming a terrain feature as claimed in claim 1 wherein the working length of the tool member is approximately 5 to 30 feet.

10. An apparatus for forming a terrain feature as claimed in claim 1 wherein the secondary forming surface extends substantially perpendicular to the plane of the length of the tool member.

11. An apparatus for forming a terrain feature as claimed as claimed in claim 10 wherein the secondary forming surface extends substantially the width of the tool member.

12. An apparatus for forming a terrain feature as claimed in claim 1 wherein the secondary forming surface comprises a rigid plate.

13. An apparatus for forming a terrain feature as claimed in claim 12 wherein the rigid plate is made of rolled hollow steel.

14. An apparatus for forming a terrain feature as claimed in claim 1 wherein the secondary forming surface comprises at least one finishing mat.

15. An apparatus for forming a terrain feature as claimed in claim 14 wherein the finishing mat comprises a textured surface.

16. An apparatus for forming a terrain feature as claimed in claim 1 wherein the apparatus for forming a terrain feature also comprises a frame for attachment to a self-actuated vehicle.

17. An apparatus for forming a terrain feature as claimed in claim 1 wherein the apparatus for forming a terrain feature also comprises a digital guidance device configured to determine the position of the tool member with respect to a terrain surface.

18. An apparatus for forming a terrain feature as claimed in claim 17 wherein the digital guidance device comprises a sensor configured to detect the location of at least one reference signal positioned on a terrain surface.

19. An apparatus for forming a terrain feature as claimed in claim 18 wherein the reference signal is a laser reference signal.

20. An apparatus for forming a terrain feature as claimed in claim 18 wherein the reference signal is a sonic reference signal.

21. An apparatus for forming a terrain feature as claimed in claim 18 wherein the reference signal is a GPS reference signal.

22. An apparatus for forming a terrain feature as claimed in claim 18 wherein the sensor is also configured to detect the angle of slope of the terrain feature.

23. An apparatus for forming a terrain feature as claimed in claim 18 wherein the digital guidance device comprises a processor to calculate the position of the tool member with respect to the detected reference signal(s) and convert resulting processed positional information to an output signal for display on a visual display.

24. An apparatus for forming a terrain feature as claimed in claim 23 wherein the positional information comprises at least one of the height of the tool member with respect to the terrain surface, the width of the tool member with respect to the terrain surface, and the inclination of the tool member with respect to the terrain surface.

25. An apparatus for forming a terrain feature as claimed in claim 23 wherein the digital guidance device also comprises a controller to receive the positional information and control the movement of the tool member with respect to the terrain surface.

26. A method of forming a terrain feature, the method comprising the steps of:

forming a terrain feature with at least one primary forming surface comprising at least one cutting edge configured to run over a substantial portion of a working surface of a tool member, the working surface adapted to a cross-sectional shape of a preferred contour of the terrain feature; and providing a finish to the terrain feature formed with the primary forming surface with at least one heated secondary forming surface.

27. A method of forming a terrain feature as claimed in claim 26, further comprising:

using a digital guidance device to determine the position of the tool member with respect to the terrain surface prior to the forming step.

* * * * *